United States Patent [19]

Gelbort

[11] Patent Number: 4,724,505

[45] Date of Patent: Feb. 9, 1988

[54] RELAY COMBINATION

[76] Inventor: Abraham Gelbort, 217 S. Arnaz Dr., Beverly Hills, Calif. 90211

[21] Appl. No.: 910,492

[22] Filed: Sep. 23, 1986

[51] Int. Cl.[4] ..... H01H 47/00; H01H 9/00

[52] U.S. Cl. ..... 361/167; 361/189; 361/192

[58] Field of Search ..... 361/166, 167, 168, 189, 361/191, 192, 194

[56] References Cited

U.S. PATENT DOCUMENTS 3,581,157 5/1971 Hall ..... 361/192
4,134,050 1/1979 Sibalis ..... 361/189

OTHER PUBLICATIONS

Joseph Benish and Alva L. Sweet, Alternating Current Relay Circuit, U.S. Patent Office Official Gazette, 7/12/49, p. 637.

*Primary Examiner*—L. T. Hix
*Assistant Examiner*—David Porterfield
*Attorney, Agent, or Firm*—Pretty, Schroeder, Brueggemann & Clark

[57] ABSTRACT

A relay combination includes a first relay having a first double throw contact set including a first normally closed contact, a first normally open contact and a first armature for contacting the first normally open and closed contacts. A first armature coil manipulates the first armature. A second relay includes a second double throw contact set including a second normally closed contact, a second normally open contact and a second armature for contacting the second normally open and closed contacts. A conductor conducts an alternating current signal to the first and second normally closed contacts. The first and second armatures are electrically coupled to one another through a conductor electrically isolated from the first and second normally closed contacts. A latching circuit is included comprising first and second input circuits for latching the first relay upon receiving a signal on the first input circuit and latching the second relay upon receiving a signal on the input circuit.

31 Claims, 4 Drawing Figures

RELAY COMBINATION

BACKGROUND OF THE INVENTION

1. Field of the Invention

The present invention relates to relays and more specifically to relays to provide reversible control over motors, etc.

2. Related Art

Controllers for such electrical components as garage door openers and window covering motors are often bulky and complex. For example, some garage door openers presently include one or more circuit boards including digital components. These are often expensive to purchase or replace. For such applications as control of movable window coverings, the size of the control can often be important where the control must be hidden from view.

Where a component such as a window covering control is controlled from more than one location, the manufacturers of the window covering control warn that the control switches should be momentary switches. This is to preclude the possibility of one switch providing a control signal conflicting with that of another switch. However, the use of momentary switches does not preclude the possibility of two people producing conflicting control signals simultaneously at different control switches. It is generally assumed by the manfacturer that such contingency would not occur.

SUMMARY OF THE INVENTION

With the present invention, a relatively small and straighfoward apparatus can be used to control reversible motors such as those used in garage door openers and window covering controls. However, the present apparatus can also be used for reliably producing two different control signals, for example, opposite control signals for controlling any number of apparatus.

According to the present invention, a relay combination includes a first relay wherein a first double throw contact set in the first relay has a first normally closed contact, a first normally open contact and a first armature for contacting the first normally open and closed contacts. A first armature coil is included for manipulating the first armature. A second relay includes a second double throw contact set in the second relay having a second normally closed contact, a second normally open contact and a second armature for contacting the second normally open and closed contacts. Conductor means are provided for conducting an alternating current signal or other appropriate signal to the first and second normally closed contacts. Means other than the armatures and electrically isolated from the first and second normally closed contacts is provided for electrically connecting the first and second armatures. Means are also provided for providing first and second input circuits for latching the first relay upon receiving a first signal on the first input circuit and latching the second relay upon receiving a signal on the second input circuit.

In one form of the invention, the first and second relays may be a pair of double pole double throw relays. In a second form of the invention, the first and second relays are single pole double throw relays and the latching means also comprises a pair of single pole double throw relays. Furthermore, a third form of the invention includes double pole double throw relays for the first and second relays and single pole single throw relays for the latching means.

With the embodiments discussed above, the signals on the input circuits of the latching means may be low voltage signals determined according to the available voltage levels. The first and second relays may be high voltage relays according to the particular apparatus being controlled. The particular relays are chosen according to the input and output requirements of the situation.

DETAILED DESCRIPTION OF THE PREFERRED EMBODIMENTS

Figure 1:
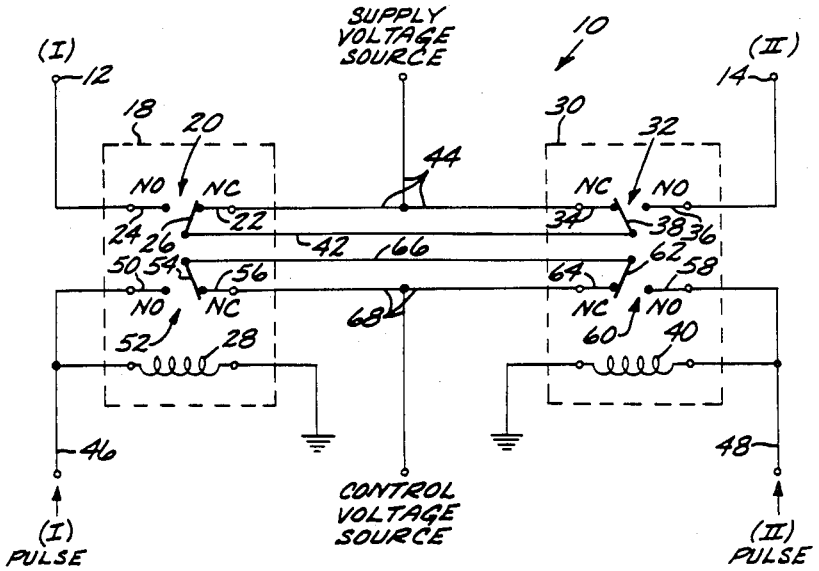
FIG. 1 is a schematic and block diagram of a relay combination according to the present invention using a pair of double pole double throw relays.
Figure 4:
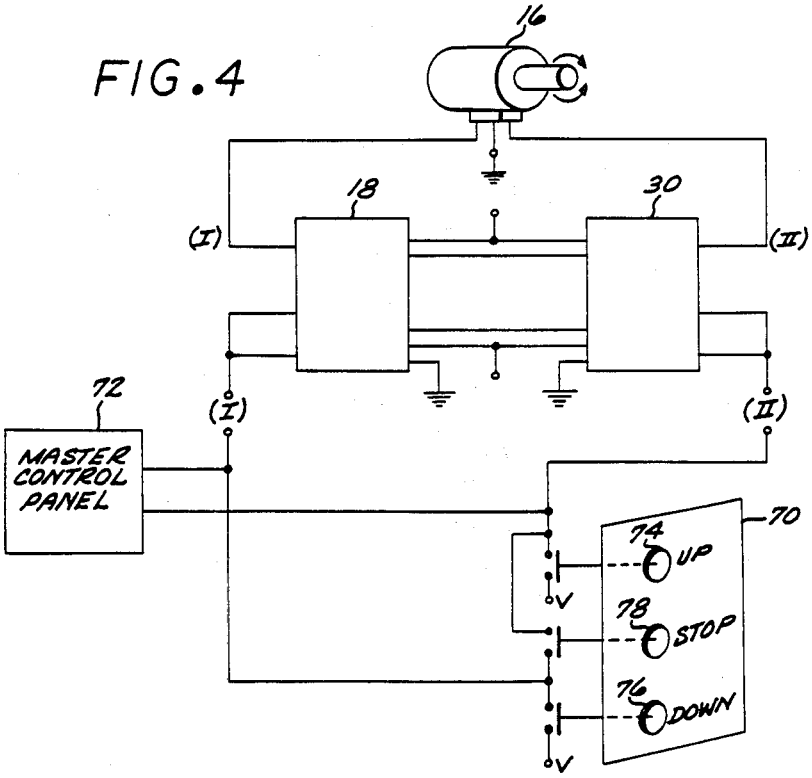
FIG. 4 is a schematic and block diagram showing an arrangement for controlling a motor using the relay combination of the present invention.

FIG. 1 shows an embodiment of the present invention in the form of a relay combination 10 for controlling a device or devices (not shown) through a first output circuit 12 and a second output circuit 14. The first and second output circuits are coupled to respective leads of an appropriate device, such as a synchronous AC motor 16 (FIG. 4).

A first relay in the form of a first double pole double throw relay 18 includes a first double throw contact set 20 having a first normally closed contact 22, a first normally open contact 24 and a first armature 26 for contacting the first normally closed contact 22 and the first normally open contact 24. The normally open contact is electrically coupled to the first output circuit 12 for operating the appropriate electrical component according to the position of the first armature 26. The first double pole double throw relay further includes a first armature coil 28 for manipulating the first armature as is known to one skilled in the art. It is to be understood that the relays described herein and shown in the drawings are depicted schematically and include components typical for the identified relays. For example, no armature return springs are shown. The double pole double throw relays individually are no different from any other double pole double throw relay. Additionally, the single pole double throw relays and the single pole single throw relays described below are individually no different from any other relay similarly labeled.

A second relay 30 includes a second double throw contact set 32 having a second normally closed contact 34, a second normally open contact 36 and a second armature 38 for contacting the second normally closed contact and the second normally open contact according to the energization of a second armature coil 40. The second normally open contact 36 is electrically coupled to the second output circuit 14 for controlling an appropriate electrical component.

A first armature conductor circuit 42 electrically couples the first armature 26 to the second armature 38 for allowing an electrical signal to be passed between the first and second armatures. A first closed contact conductor circuit 44 simultaneously conducts an alternating current signal from a supply voltage source to the first and second normally closed contacts. The signal conducted over the conductor circuit 44 may be a direct current signal from an appropriate direct current voltage source. Additionally, the entire relay combination may be operated and controlled by a direct current source or a combination of an alternating current source for the supply voltage source and a direct current source for the control voltage source, or vice versa. Additionally, the voltages of the supply and control voltage sources may be the same or different as necessary. However, the discussion hereafter will relate to alternating current signals as these are common in home and industrial applications. The first closed contact conductor circuit 44 is electrically isolated from the first armature conductor circuit 42 and vice versa except when either of the first and second armatures 26 and 38, respectively, are in electrical contact with their respective normally closed contacts. This is so that the armatures control the passage of the alternating current signal from the supply voltage source to the first armature conductor circuit 42.

The remainder of the relay combination includes first and second input circuits 46 and 48, respectively. The first input circuit is for providing an input pulse or current signal to the first armature coil 28, and the second input circuit 48 is for providing an input pulse or current signal to the second armature coil 40.

The first input circuit 46 is coupled through the first armature coil 28 to ground. The first input circuit is also coupled to an additional or first lower normally open contact 50 in an additional or first lower contact set 52. The first lower contact set 52 includes an additional or first lower armature 54 and an additional or first lower normally closed contact 56. The terms "lower" used herein refers to the relative position of the contact sets as shown in the schematic drawings and are not related to any descriptive feature of the actual relays.

The second input circuit 48 is coupled through the second armature coil 40 to ground. The second input circuit is also coupled to an additional or second lower normally open contact 58 in an additional or second lower contact set 60. The second lower contact set includes an additional or second lower armature 62 and an additional or second lower normally closed contact 64.

A second armature conductor circuit 66 electrically couples the first lower armature 54 with the second lower armature 62 so that an alternating current signal can pass between the two armatures such as a signal from a control voltage source. A second normally closed contact circuit 68 is coupled between the first lower normally closed contact 56 and the second lower normally closed contact 64 and to the control voltage source for providing an alternating current signal from the control voltage source simultaneously to each of the lower normally closed contacts 56 and 64. The second armature conductor circuit and the second normally closed contact circuit 66 and 68, respectively, are electrically isolated except during electrical connection of either of the first lower armature or the second lower armature with the corresponding normally closed contact. This is so that passing of an alternating current signal over the armature conductor circuit 66 from the control voltage source coupled to the closed contact circuit 68 is controlled by either of the armatures 54 and 62.

The input and output circuits, the armature coils, the first and second lower contact sets, the armature conductor circuit 66 and the closed contact circuit 68 form a latching circuit for latching the first relay 18 upon receiving a signal on the first input circuit 46 and latching the second relay 30 upon receiving a signal on the second input circuit 48, as described more fully below.

The supply voltage source coupled to the first and second double throw contact sets is a voltage source such as one at line voltage of 110 volts or 220 volts to operate the motor. The character of the voltage source will be determined by the particular component being controlled by the relay combination. Furthermore, the particular types of double pole double throw relays will also be determined in part by the component being controlled. For example, for a relay combination controlling a garage door opener or other household device, the supply voltage source and the ratings of the relays will correspond to 110 volts in the United States and 220 volts for countries such as the European countries. The control voltage signal being supplied to the second normally closed contact circuit 68 may be configured according to the characteristics of the control switch or other control panel providing input to the first and second input circuits 46 and 48. For example, the control voltage source and the ratings of the relays may correspond to 16 or 24 volts. Alternatively, where the control switch is an ordinary household momentary switch, the voltage signal may be a 110 volt or a 220 volt control signal. Alternatively, where the input control is from a computer or other digital control device, the control voltage supply may be a five volt supply. Generally, the type of relay and the characteristics of the voltage supplies will be determined by the controlled device and by the characteristics of the input device used for inputting signals to the input circuits.

Consider now the operation of the relay combination shown in FIG. 1. It will be assumed for purposes of discussion that the relay combination controls a synchronous AC motor for moving a window covering (not shown) up and down. It will also be assumed that two different switches are coupled to the input circuit, one switch being in the room having the window over which the window covering extends, the second being in a master control switch. Such an arrangement is depicted schematically in FIG. 4 showing the wall switch 70 and the master control panel 72. It will be assumed that the upward motion of the window covering and the corresponding rotation of the motor 16 is controlled by the up button 74 and a corresponding up button in the master control panel, through the portion of the circuit shown in FIG. 4 labeled as (II). It will also be assumed that the downward motion of the window covering and the corresponding rotation of the motor 16 is controlled by the down button 76 and a corresponding down button in the master control panel 72 through the portion of the circuit of FIG. 4 labeled (I). The stop button 78 stops the rotation of the motor 16 and therefore the motion of the window covering. The buttons on the wall switch 70 are momentary switches and serve to provide an appropriate pulse from an electrical source (V in FIG. 4) for operating the relays as described below. The type of electrical power source and the coupling of the power source for providing pulses upon actuation of the wall switch would be apparent to one skilled in the art considering the description herein. Where the wall switch and master control panel operate off of the line voltage signal in a residence, the electrical voltage supply V is the line voltage from the house.

When the down button 76 is depressed, the circuit between V and the first relay 18 is momentarily closed sending a pulse to the first relay. The pulse energizes the first armature coil 28 (FIG. 1) to break the contact of the first armature 26 from the normally closed contact 22 and the first lower armature 54 from the first lower normally closed contact 56. The armatures then make contact with corresponding normally open contacts 24 and 50. Since there is no pulse through the second input circuit to the second relay 30, the armatures 38 and 62 remain unchanged. Because of the making of contact between the first lower armature and the first lower normally open contact 50, an alternating current signal is conducted through the circuit comprised of the following: conductor 68, the second lower normally closed contact 64, armature 62, conductor 66, the first lower normally open contact 50 and armature 28. A similar path is followed by the alternating current signal from the supply voltage source through the conductor 44 and the first normally closed contact 34. The alternating current signal is conducted through the second armature 38, the conductor 42, the first armature 26 and to the first normally open contact 24. The alternating current signal then is conducted from the first relay through the first output 12 to the appropriate lead of the motor 16. As a result, the motor begins to turn to lower the window covering. As a result of the alternating current signals from the control voltage source along conductors 68 and 66, and through coil 28, the first relay remains latched so that the alternating current signal being output along the output circuit 12 is maintained. This continues until an internal limit switch in the motor 16 turns off the motor or until the stop button is depressed. If desired, this limit switch may also be coupled to the wall switch or main control panel so that the relay can be unlatched.

If the up button is depressed on the wall switch 70, the corresponding contact is momentarily closed so that a pulse is passed along the circuit II to the second relay 30. The pulse energizes the coil 40 to break the contacts between the second normally closed contact 34 and the corresponding armature 38 and between the second lower normally closed contact 64 and its corresponding armature 62. Energization of the coil 40 also causes making of contact between the second armature 38 and the second normally open contact 36 and also making of contact between the second lower armature 62 and the second lower normally open contact 58. For the output circuit 14, an alternating current signal is provided from the supply voltage source through conductor 44, the first normally closed contact 22, the first armature 26 and conductor 42 to the armature 38, the second normally open contact 36, and the output circuit 14. Similarly, the alternating current signal applied to the circuit 68 is passed through the first lower normally closed contact 56, the first lower armature 54, circuit 66, the lower second armature 62, the second lower normally open contact 58 and to ground through the coil 40, thereby latching the second relay 30. Since the pulse is momentary, the armature coil 40 is ultimately energized by the alternating current signal from the control voltage source.

In order to stop the rotation of the motor, and therefore the motion of the window covering, the stop button 78 may be depressed. This momentarily closes the corresponding contact and shorts the input circuits 46 and 48. If it is assumed that the second relay 30 is latched so that the window covering is being raised, the first armature coil 28 will be energized, thereby breaking the contact between the first normally closed contact 22 and the first armature 26 and also between the lower normally closed contact 56 and the corresponding armature 54. Contact is made between the lower normally open contact 24 and the corresponding armature 26 and also between the normally open contact 50 and the corresponding armature 54. The making of contact removes the alternating current supply from the motor since there is a closed circuit between the first output circuit 12 and the second output circuit 14 through the conductor 42. Additionally, an open circuit exists to the control voltage source at the conductor 68 since the armatures 54 and 62 are in contact with the corresponding normally open contacts. Since there is no alternating current signal being applied over conductor 68, the armature coils 28 and 40 cannot latch the relays. The same process occurs if one button on the wall switch is depressed simultaneously with the depression of the opposite button on the master control panel so that pulses are applied to both armature coils 28 and 40. This minimizes the possibility of damage to the motor as a result of conflicting control signals. Additionally, the first and second contact sets are electrically separated from the corresponding lower contact sets. Therefore, the alternating current signals to the first and second contact sets are separate from the alternating current signals to the first and second lower contact sets.

Figure 2:
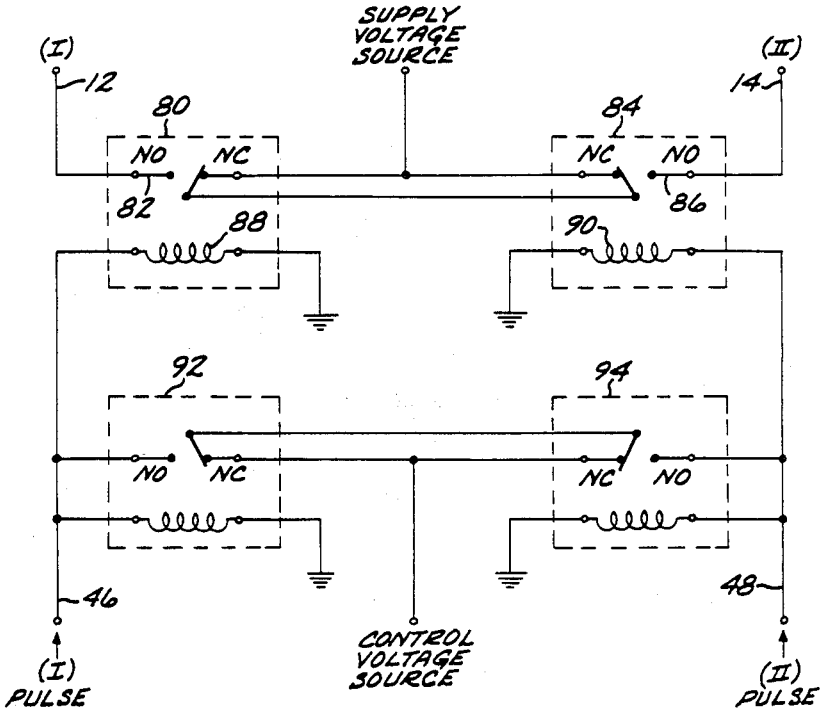
FIG. 2 is a schematic and block diagram showing a further embodiment of the invention using four single pole double throw relays.

FIG. 2 shows a further embodiment of the present invention showing four single pole double throw relays. A first single pole double throw relay 80 includes a normally open contact 82 coupled to the first output circuit 12. A second single pole double throw relay 84 includes a second normally open contact 86 coupled to the second output circuit 14. The armatures and the normally closed contacts are similar in structure and function to those in the first and second contact sets in the double pole double throw relays of FIG. 1. A first armature coil 88 is energized by pulses from the first input circuit 46 and a second armature coil 90 is energized by a pulse from the second input circuit 48. Third and fourth single pole double throw relays 92 and 94, respectively, along with the first and second armature coils 88 and 90 latch the first single pole double throw relay 80 upon receiving a signal on the first input circuit and latch the second single pole double throw relay 84 upon receiving a signal on the second input circuit. The third and fourth relays are coupled in a manner similar to the coupling of the first and second lower contact sets 52 and 60 and the first and second armature coils 28 and 40 in the relays of FIG. 1. The four single pole double throw relays can be substituted for the two double pole double throw relays shown in FIG. 1 to control an appropriate component such as a motor. With a pulse on the first input circuit 46, the first and third relays will latch. A pulse on the second input circuit 48 latches the second and fourth relays. Pulses on both input circuits will return the relays to their normally closed configurations until such time as an additional pulse is input to the relay combination.

The relay combination of FIG. 2 also provides for electrical separation of the first and second contact sets in the first and second relays from the circuits in the third and fourth relays. As a result, one type of supply voltage source may be used to meet the requirements of the particular device being controlled by the relays and a different control voltage source can be used to control the operation of the relays.

Figure 3:
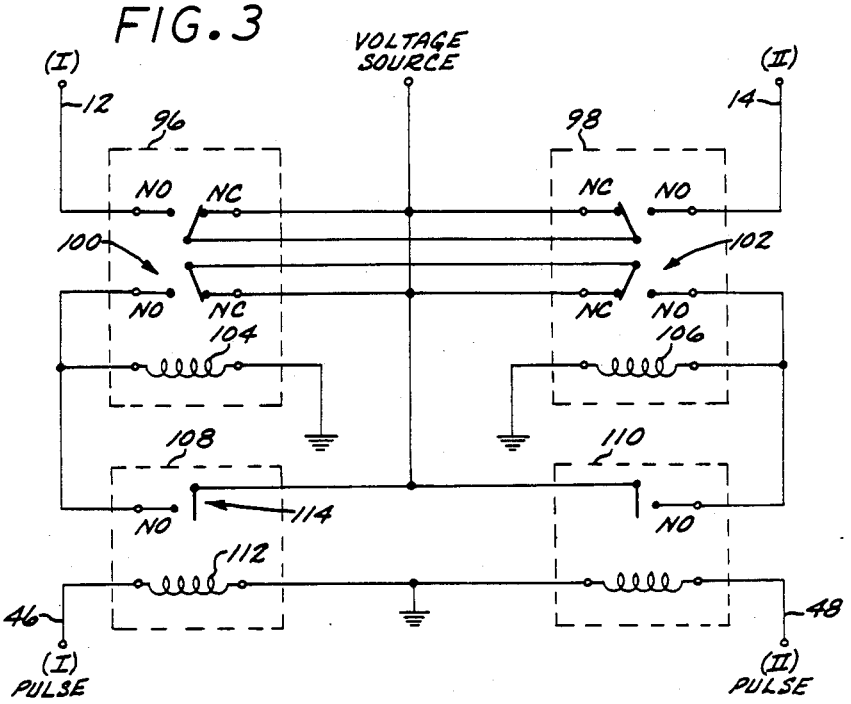
FIG. 3 is a further embodiment of the present invention using a pair of double pole double throw relays and a pair of single pole single throw relays.

FIG. 3 shows a first double pole double throw relay 96 and a second double pole double throw relay 98 and a supply and control voltage source. First and second double throw contact sets in the first and second relays are coupled in a manner similar to that described above with respect to FIG. 1. The first and second double throw contact sets can be latched in a manner similar to that described above for providing signal output through either of the first and second output circuits 12 and 14, respectively. Latching of either of the first and second contact sets in controlled by an additional or first lower double throw contact set 100 and an additional or second lower double throw contact set 102 coupled to each other in a manner similar to that described above with respect to the lower double throw contact sets of FIG. 1 except that in FIG. 3 the combination of the lower contact sets is coupled to the same voltage source as the first and second contact sets. The first and second lower contact sets include normally open contacts coupled to ground through respective armature coils 104 and 106. The armature coils break and make contact in the double pole double throw relays and latch the contacts as appropriate. The normally open contacts in the lower contact sets and the armature coils 104 and 106 are coupled respectively to a first single pole single throw relay 108 and a second single pole single throw relay 110. The first and second single pole single throw relays are coupled to the relay combination as indicated in FIG. 3.

If a pulse is received on the first input circuit 46, the coil 112 is energized causing the armature to contact the normally open contact in the contact set 114. This closes the circuit between the voltage source and the coil 104 in the first double pole double throw relay. Energization of the coil 104 breaks and makes the contacts in the first double throw contact set and the first lower double throw contact set 100 so that an alternating current signal is applied to the first output circuit 12 through the first double throw contact set and so that an alternating current signal is also applied to the coil 104 through the first lower double throw contact set 100. The latter alternating current signal latches the first double pole double throw relay 96 until such time as the latched contact in the first lower double throw contact set 100 is broken. similarly, a pulse may be applied at the second input circuit 48 for latching the second double pole double throw relay 98. Simultaneous application of a pulse to the first and second input circuits causes the contacts in the relays 108 and 110 to make contact and therefore the contacts in the double throw contact sets 100 and 102 to make contact. This breaks any latch present in the first or second double pole double throw relays 96 and 98.

With the above described embodiments, a low voltage signal can be used to change directions in a motor or generally to change the output signals of the relay combination. Shorting of the two input circuits will turn off the motor or remove the output signals from the output circuits 12 and 14. Additionally, the relay combination will maintain a given output signal even though the input signal is removed. Shorting of the input circuits for the relay combinations of FIGS. 1 and 2 will also remove the output signals from the output circuits 12 or 14. Only one output signal is provided from the relay combination at any one time.

It should be noted that the above are preferred configurations, but others are foreseeable. The described embodiments of the invention are only considered to be preferred and illustrative of the inventive concept. The scope of the invention is not to be restricted to such embodiments. Various and numerous other arrangements may be devised by one skilled in the art without departing from the spirit and scope of the invention. For example, use of the relay combination is not limited to motors such as those used in garage door openers and window coverings. For example, Chapter 2 of *Engineer's Relay Handbook*, Hayden Book Co., Inc., New York, Library of Congress Catalog No. 66-23643, incorporated herein by reference, describes several relay applications for which the present invention can be adapted.

What is claimed is:

1. A relay combination comprising:

a first relay;

a double throw contact set in the first relay having a first normally closed contact, a first normally open contact and a first armature for contacting the first normally open and closed contacts;

a second relay;

a second double throw contact set in the second relay having a second normally closed contact, a second normally open contact and a second armature for contacting the second normally open and closed contacts;

conductor means for conducting an electrical signal to the first and second normally closed contacts;

means electrically isolated from the first and second normally closed contacts, when the normally closed contacts are open, for electrically connecting the first and second armatures; and means comprising first and second input circuits for latching the first relay upon receiving a signal on the first input circuit and latching the second relay upon receiving a signal on the second input circuit.

2. The relay combination as claimed in claim 1 wherein the first relay comprises a double pole double throw relay.

3. The relay combination as claimed in claim 2 wherein the second relay comprises a double pole double throw relay.

4. The relay combination as claimed in claim 2 wherein the latching means comprises an additional first double throw contact set comprising an armature, a normally open contact and a normally closed contact and an additional second double throw contact set comprising a respective armature, normally open contact and normally closed contact and wherein the additional first and second armatures are electrically coupled together and wherein the relay combination further comprises conductor means for conducting an electrical signal to the additional first and second normally closed contacts.

5. The relay combination as claimed in claim 4 further comprising first and second relay coils for operating on respective armatures.

6. The relay combination as claimed in claim 5 wherein the first and second relays are coupled such that movement of the additional first armature to the additional first normally open contact allows an electrical signal to pass from the additional second normally closed contact to the additional first normally open contact.

7. The relay combination as claimed in claim 1 wherein the first normally open contact is coupled to one lead of a reversible motor and the second normally open contact is coupled to a second lead of the motor.

8. The relay combination as claimed in claim 7 wherein the motor comprises a motor for opening a garage door.

9. The relay combination as claimed in claim 7 wherein the motor comprises a motor for operating a window covering.

10. The relay combination as claimed in claim 1 wherein the current conductor means comprises means for conducting a signal simultaneously to the first and second normally closed contacts.

11. The relay combination as claimed in claim 1 wherein the first and second relays are coupled such that latching of the first armature to the first normally open contact allows an electrical signal to pass from the second normally closed contact through the electrical connecting means to the first armature.

12. The relay combination as claimed in claim 1 further comprising first and second momentary switches coupled respectively to the first and second input circuits.

13. The relay combination as claimed in claim 1 wherein the first relay comprises a single pole double throw relay.

14. The relay combination as claimed in claim 13 wherein the second relay comprises a single pole double throw relay.

15. The relay combination as claimed in claim 14 wherein the latching means comprises a third single pole double throw relay comprising a double throw contact set having an armature, a normally open contact and a normally closed contact and a fourth single pole double throw relay having a double throw contact set comprising an armature, a normally open contact and a normally closed contact and wherein the armatures in the third and fourth relays are electrically coupled together and wherein the relay combination further comprises conductor means for conducting an electrical signal to the normally closed contacts in the third and fourth relays.

16. The relay combination as claimed in claim 15 further comprising first and second relay coils for operating on respective armatures.

17. The relay combination as claimed in claim 16 wherein the third and fourth relays are coupled such that latching of the armature in the third relay to the normally open contact in the third relay allows an electrical signal to pass from the normally closed contact in the fourth relay to the normally open contact in the third relay.

18. The relay combination as claimed in claim 1 wherein the latching means comprises an additional first double throw contact set comprising an armature, a normally open contact and a normally closed contact and an additional second double throw contact set comprising an armature, a normally open contact and a normally closed contact and wherein the additional first and second armatures are electrically coupled together and wherein the relay combination further comprises conductor means for conducting an alternating current signal to the additional first and second normally closed contacts and wherein the relay combination further comprises a first single pole single throw relay having a normally open contact electrically coupled to the additional first normally open contact and a second single pole single throw relay having a normally open contact coupled to the additional second normally open contact.

19. The relay combination as claimed in claim 18 further comprising first and second relay coils for operating on respective armatures.

20. The relay combination as claimed in claim 19 wherein the first and second double pole double throw relays are coupled such that movement of the additional first armature to the additional first normally open contact allows an alternating current signal to pass from the additional second normally closed contact through the electrical connecting means to the additional first armature.

21. The relay combination as claimed in claim 1 wherein the conductor means comprises means for coupling to a high voltage source.

22. The relay combination as claimed in claim 21 wherein the latching means comprises means for coupling to a low voltage source.

23. A relay combination comprising:

a first relay;

a double throw contact set in the first relay having a first normally closed contact, a first normally open contact and a first armature for contacting the first normally open and closed contacts;

a first armature coil for manipulating the first armature;

a second relay;

a second double throw contact set in the second relay having a second normally closed contact, a second normally open contact and a second armature for contacting the second normally open and closed contacts;

conductor means for conducting an electrical signal to the first and second normally closed contacts;

means separate from the first and second normally closed contacts for electrically connecting the first and second armatures; and means comprising first and second input circuits for latching the first relay upon receiving a signal on the first input circuit and latching the second relay upon receiving a signal on the second input circuit.

24. A relay combination comprising:

a first double throw relay having a first double throw contact set, including a first normally closed contact and a first armature;

a second double throw relay having a second double throw contact set, including a second normally closed contact and a second armature;

means for supplying an electrical signal to the first armature through the second normally closed contact and second armature when the first normally closed contact is opened; and means comprising first and second input circuits for latching the first relay upon receiving a signal on the first input circuit.

25. The relay combination as claimed in claim 24, wherein the first and second relays are double pole, double throw relays.

26. The relay combination as claimed in claim 24, comprising a third double throw relay having a thrid double throw contact set including a third normally closed contact and a third armature, and a fourth double throw relay having a fourth double throw contact set including a fourth normally closed contact and a fourth armature, wherein the third and fourth normally closed contacts are electrically coupled.

27. A relay combination for controlling a component such as a motor, capable of existing in at least two states, such as forward and reverse, the combination comprising:

a first relay comprising a first double throw contact set having an armature and a normally closed contact;

a second relay comprising a second double throw contact set having an armature electrically coupled to the armature in the first relay and a second normally closed contact coupled to the normally closed contact in the first relay; and means comprising a voltage supply source and at most first and second control signal inputs for latching the first relay upon receipt of a control signal on the first control signal input and for latching the second relay upon receipt of a control signal on the second control signal input and wherein the first and second relays are substantially unlatched when a signal is simultaneously applied to both the first and second control signal inputs.

28. The relay combination as claimed in claim 5 wherein the first relay coil is coupled to the first additional normally open contact.

29. The relay combination as claimed in claim 28 wherein the second relay coil is coupled to the second additional normally open contact.

30. The relay combination as claimed in claim 1 wherein the latching means comprises means for latching the first relay with electrical power through the second relay.

31. A relay combination comprising:

a first relay having a first input circuit and a first output circuit;

a second relay having a second input circuit and a second output circuit;

means for coupling an electrical power supply to only one of the first and second output circuits at a given time upon application of an electrical signal to a corresponding one of the first and second input circuits;

a first relay coil coupled to the first input circuit;

a first double throw contact set in the first relay including a first normally open contact coupled to the first input circuit and to the first relay coil, a first normally closed contact and a first armature;

a second relay coil coupled to the second input circuit; and a second double throw contact set in the second relay including a second normally open contact coupled to the second input circuit and to the second relay coil, a second normally closed contact electrically coupled to the first normally closed contact and to a circuit for supplying electrical power to the first and second normally closed contacts and a second armature electrically coupled to the first armature.

* * * * *

UNITED STATES PATENT AND TRADEMARK OFFICE

CERTIFICATE OF CORRECTION

PATENT NO. : 4,724,505

DATED : 2-9-88

INVENTOR(S) : Abraham Gelbort

It is certified that error appears in the above-identified patent and that said Letters Patent is hereby corrected as shown below:

In column 1, line 34, delete "straighfoward" and insert therefor -- straightforward --.

In column 7, line 16, delete "in" and insert therefor -- is --.

In column 7, line 50, capitalize the "s" in "similarly".

In column 10, line 64, delete "thrid" and insert therefor -- third --.

Signed and Sealed this

Nineteenth Day of July, 1988

*Attest:*

DONALD J. QUIGG

*Attesting Officer*

*Commissioner of Patents and Trademarks*